United States Patent [19]

Yoshida et al.

[11] 4,024,039

[45] May 17, 1977

[54] COLORING METHODS FOR ALUMINUM AND ALUMINUM ALLOYS

[75] Inventors: Shoji Yoshida, Kobe; Yoshizo Ito, Kakogawa; Yoshihiro Sakasita, Kobe; Tatsuhiko Kobata, Akashi, all of Japan

[73] Assignee: Honny Chemicals Company, Ltd., Kobe, Japan

[22] Filed: Jan. 23, 1975

[21] Appl. No.: 543,417

Related U.S. Application Data

[63] Continuation of Ser. No. 285,220, Aug. 31, 1972, abandoned.

[52] U.S. Cl. ..... 204/181; 204/35 N; 204/38 E; 204/42; 204/58

[51] Int. Cl.[2] ..... C25D 11/22; C25D 13/06

[58] Field of Search ..... 204/35 N, 40, 29, 58, 204/38 E, 181, 56 R, 42

[56] References Cited

UNITED STATES PATENTS

| | | | |
|---|---|---|---|
| 3,546,016 | 12/1970 | Pavelich et al. | 117/232 |
| 3,664,932 | 5/1972 | Patrie | 204/35 N |
| 3,672,966 | 6/1972 | Geisler et al. | 204/35 N |
| 3,711,313 | 1/1973 | Nagano et al. | 117/49 |
| 3,795,590 | 3/1974 | Patrie | 204/35 N |

*Primary Examiner*—G. L. Kaplan
*Attorney, Agent, or Firm*—Stevens, Davis, Miller & Mosher

[57] ABSTRACT

A method for coloring aluminum and aluminum alloys comprising passing an alternating current from the article of aluminum or aluminum alloys having an oxidized film thereon through an aqueous solution of one or more salts of one or more metals of Group VIII of the periodic table, and thereafter passing a direct current through an aqueous solution of electrolyte utilizing the aluminum material as the anode wherein said solution may have a conductivity of more than 10 $\mu\Omega^{-1}$c-$m^{-1}$, be the same as the one used when employing the alternating current or contain a water-soluble resin. The electrolyte is free of added acid.

12 Claims, No Drawings

COLORING METHODS FOR ALUMINUM AND ALUMINUM ALLOYS

This is a continuation of application Ser. No. 285,220 filed Aug. 31, 1972, now abandoned.

The present invention relates to the coloring of aluminum or aluminum alloys. More particularly, it pertains to a novel method of coloring which is characterized by subjecting aluminum or aluminum alloys having an oxidized film formed by anodic oxidation to an alternating current in an electrolyte comprising an aqueous solution of metallic salt containing metals of Group VIII of the periodic table and then passing a direct curent with the aluminum material as the anode through an aqueous solution of electrolyte wherein said solution may have a conductivity of more than 10 $\mu\Omega^{-1}cm^{-1}$, be the same as the one used when employing the alternating current or contain a water-soluble resin.

It is known to color aluminum or aluminum alloys with paint which contains a pgiment or dye. This method of coloring does not produce always uniformity of shade because of the non-uniformity in thickness of the film coat. In addition, the lustrous metallic feeling of aluminum is impaired because the surface of aluminum is covered with an opaque colored film. Furthermore, when the paint is scratched the metallic surface appears.

It is known to color aluminum or aluminum alloys with dye on an anodic oxidized film. Thie method of coloring produces a beautiful and clear color. However, because the dyes are organic materials the colored film is unstable and shows little resistance to weather. Thus, this method is limited to use indoors.

Aluminum or aluminum alloys have been colored by special chemical treatment. This coloring method is unsatisfactory due to the adhesive weakness between the colored layer and the aluminum surface. As a result this method has not been accepted widely in industry.

It is also known to color aluminum or aluminum alloys by applying coloring simultaneously with anodic oxidation in a solution containing organic acids such as sulfonic acid. This method produces a durable colored film, and, therefore, may be employed out of doors. However, this method is difficult to control and results in non-uniform tone of color when the method is operated continuously.

Coloring aluminum alloys having a special component by means of anodic oxidation is known. This method produces a product suitable for architectural application because of its good weather resistance. However, a specially prepared aluminum alloy is usually required for the coloring which makes it difficult to produce various tones of color using the same aluminum alloy.

Also it is known to color by a process in which aluminum or aluminum alloys treated by anodic oxidation are subjected to alternating current in an acidic solution of metallic salts with inorganic or organic acids and/or with their ammonium, amino and imino salts. This method although widely used does not give constant color tone. The tone of color disperses as the solution in the electrolytic bath changes with time. Substandard products are produced which renders this process unsuitable for industry.

As can be seen many methods have been used widely to color aluminum or aluminum alloys but all have been accompanied by certain disadvantages.

The present invention is an improvement on the coloring methods mentioned above. Namely anodic oxidation of aluminum or aluminum alloys is carried out to create an oxidized film thereon after which the aluminum material is placed in an aqueous solution of one or more salts of one or more metals of Group VIII of the periodic table and an alternating current is passed through the solution. After passage of an alternating current, a direct current is passed through an aqueous solution of electrolyte using the aluminum material as an anode. colored aluminum articles are produced by this process. The special features of this invention are the treatment of aluminum or aluminum alloys by the processes described above and the color appearing in the last process step. By this method, superior uniformly colored articles are produced in contrast to the products produced from methods previously known.

The coloring mechanism of the present invention is not yet clearly established but one may speculate that on passsage of alternating current through the solution of metallic salts, the metal ions are introduced into the pores on the surface of the aluminum having an oxidized film. Upon passing a direct current from the aluminum material as an anode, the metal ions present in the pores act electrochemically and the color forms.

When a metal and/or metallic oxide are present in the pores of the aluminum, the elecgtroconductivity concentrates largely in this area.

Furthermore, the amount of electric current increases in this area to a greater degree than in other areas. Additionally the metal ions in aqueous solution concentrate in this area. Thus, the surface of the aluminum is colored irregularly. However, according to the present method, only metal ions are introduced into the pores and the color forms uniformly. Furthermore, this method is rather easily operated and gives a constant tone of colored aluminum articles regardless of different batches.

According to the present invention only metallic salts are involved in the solution of electrolyte. Acids and/or their ammonium salts which have been used previously are not present. Without acids and/or their ammonium salts the composition and the pH of the solution which are necessary to produce the aluminum articles having uniform tone of color are easily adjusted. In addition a constant tone of color is given because the solution is relatively easy to maintain.

Formerly when an inorganic or an organic acid was included in a solution of electrolyte, a trace amount of the acid often remained on the surface of the aluminum even though the surface of the aluminum was washed with water. Thus when the aluminum material was immersed in a solution of resin, the acid contaminated the solution. Also a non-uniform film or bubbles often was formed on the surface of the aluminum. However, by not using the acid in solution the defective features described above are eliminated.

The present invention is explained in more detail by the following:

In the process of this invention the step of anodic oxidation of the aluminum or aluminum alloys can be considered as known. This anodic oxidation is undertaken at a temperature of from about 0° to 30° C., but with a temperature of from 15° to 25° C. being preferred. Also it is desirable to maintain changes of temperature to within 2° C. to obtain uniformity throughout the product. Further, the direct current density may be from 0.5 to 3.0 A/dm$^2$, but a direct current density of 0.8 to 2.0 A/dm$^2$ is preferred. This method is applicable not only to aluminum or aluminum alloys treated by anodic oxidation but also to those treated chemically.

After anodic oxidation, aluminum or aluminum alloys having an oxidized film thereon are subjected to alternating current in an aqueous solution of one or more salts of one or more metals of Group VIII of the periodic table.

Especially desirable metals of the salts are iron, cobalt and nickel.

For desirable metallic salts there may be mentioned ferrous sulfate, ferrous phosphate, ferrous nitrate, ferrous acetate, ferrous furmarate, nickel sulfate, nickel phosphate, nickel nitrate, nickel acetate, nickel propionate, nickel formate, cobalt sulfate, cobalt nitrate, cobalt formate, cobalt acetate, cobalt phosphate, and cobalt propionate. Usually these metallic salts are employed as a mixture, but a single salt in aqueous solution is sufficient for coloring.

In the alternating current step the counterelectrode may be a material, such as graphite, which is inert to the electrolyte, or it may be formed of another conductive composition, e.g., metal, which advantageously may be selected from among metals having a solution potential more noble than aluminum in the conventional series of electrode potentials.

The temperature of the aqueous soulution is from 5° to 40° C., but with a temperature of from 10° to 35° C. being preferred. During the passage of alternating current any change of temperature is desired to be kept within 3° C. to maintain a uniformity of color.

Further the voltage of alternating current is kept below about 30 volts, with 5 to 25 volts being preferred. According to the coloring desired an alternating current is passed through the aqueous solution for from 2 to 30 minutes. In an aqueous solution of metallic salts, the concentration is more than 0.2 weight percent with from 0.5 to 15 weight percent being preferred. Further, the pH of the solution is decided by the metallic salt used and its concentration. The value for the pH of this solution is lowered when the metal ions are present in the pores on the surface of aluminum having the oxidized film. When the pH is lowered, it is desirable to remove excess anion because it exerts a bad influence upon the coloring of the oxidized film. A conventional anion exchange resin or other suitable procedure may be employed for this purpose.

In connection with these process steps, three related methods will be described.

In the first method of the electrochemical treatment, aluminum or aluminum alloys oxidized by anodic oxidation are treated with an alternating current in an aqueous solution of metallic salts containing metals of Group VIII of the periodic table and then this aluminum material is treated with a direct current in aqueous solution of electrolyte of more than $10\mu\Omega^{-1}cm^{-1}$ conductivity.

Subsequently, the metallic ions present in the pores act electrochemically to color the oxidized film on the aluminum. The metal ions introduced into the pores change immediately to metal and/or metallic oxide and consequently the oxidized film is colored. The electrical conductivity of an aqueous solution for the direct current electrolysis should be above $10\mu\Omega^{-1}cm^{-1}$.

When the conductivity of the solution is less than 10 $\mu\Omega^{-1}cm^{-1}$ such as with deionized water, the current is too small and the coloring tends to be insufficient.

The coloring is not directly effected by large conductivity but the operation requires special control, namely, the process capacity and/or the heat of reaction. Thus, the control of the voltage through the electrolyte must take into consideration, e.g., the process capacity and/or heat of reaction.

In this case, it obviously would be preferable to use an aqueous solution for coloring having the least possible amount of solute and/or be free of chlorine ion. A strongly alkaline or acid solution especially should be avoided because a strong alkaline solution corrodes the oxidized film of aluminum while a strong acid solution dissolves the heavy metals. Consequently, the ph of the aqueous solution should be maintained from about 2 to 11.

The aqueous solution of electrolyte used in this invention has a conductivity of more than 10 $\mu\Omega^{-1}cm^{-1}$. In this aqueous solution of electrolyte there may be an inorganic acid, an organic acid, an oxy acid, an inorganic base, a metallic base or an organic base such as ammonia, amine and imine.

The concentration of this aqueous solution of electrolyte can be selected to obtain the necessary electrical conductivity, according to its respective degree of dissociation. When a strong electrolyte such as sodium nitrate is used, the concentration of the aqueous solution should be above 0.0001 weight percent.

The second method is characterized by the aluminum having an oxidized film being treated with an alternating current in aqueous solution of metallic salt containing metal of Group VIII of the periodic table, with this solution subsequently being used continuously for the treatment carried out with the direct current.

In this case, it is considered that the oxidized film on the surface of the aluminum may be colored by electrochemical reaction occurring around the electrode. In this method, the counterelectrode may be a material, such as graphite, metal, etc.

Further, the desirable conditions for the direct current application are that it be applied at room temperature, have a voltage of 10–200 volts and a charging time of ½– 10 minutes.

In the third method, after the anodic oxidation of the aluminum or aluminum alloys, an alternating current is passed as described in the first and second methods followed by a direct current through a solution of water-soluble resin using aluminum or aluminum alloys treated as in the above processes, as an anode.

According to this method, both the process of coloring and the process of electrodeposition progress simultaneously.

The special features of this method are than the oxidized film of aluminum is colored electrochemically through the process of electrodeposition, while its material is coated spontaneously with resins.

In the case of electrodeposition coating, a dispersion, emulsion or solution of the following resins may be employed: acrylic, alkyd, acrylic-alkyd, epoxy and phenol types with organic or ammonium hydroxide and also water-soluble resins with melamine resins.

The cathode generally used is an aluminum plate or stainless-steel plate.

The desirable conditions for electrodeposition coating are that the resinous liquid has a concentration of 3–40 percent, a temperature of from 10° to 30° C. and a pH of from 7.5 – 10.5. The direct current should have a voltage of 50–300 volts with the charging time being from ½– 5 minutes.

In each step of the present invention, the aluminum materials are washed before the next step is applied.

The temperature of the water in which the aluminum materials are washed after both the anodic oxidation and the alternating current treatment may range from room temperature to 100° C.

The colored aluminum articles produced by such a method can be used without a resin coating.

However, after both the treatment with an alternating current and the treatment with a direct current are carried out in the same solution of metallic salts, or after the treatment with a direct current is carried out in an aqueous solution of more than 10 $\mu\Omega^{-1}cm^{-1}$ conductivity, the aluminum articles produced can be coated with resins, if desired.

Well-known methods of applying powder, solvent and water-soluble paints such as electrostatic deposition, spraying, electrodeposition and dip-coating can be practiced with this invention.

The various paints can be applied according to known coating methods.

This invention is further explained in connection with the following examples, but it is to be understood that the scope of this invention is not to be limited to the examples described herein.

EXAMPLE 1

After the aluminum plate has been degreased with trichloroethylene, the anodic oxidation is carried out for 30 minutes in a 5 wt.% solution of sulfuric acid, at 20° C., with a direct current having a current density of 1.5 A/dm$^2$.

The oxidized aluminum plate is washed with water at room temperature and the surface is colored using the following treatment.

The plate is immersed in a 5 wt.% aqueous solution of ferrous sulfate and treated for 10 minutes with alternating current of 10 volts at 25° C. using the plate and a carbon bar as electrodes.

Subsequently, the plate is treated for 2 minutes in the same solution with a direct current of 50 volts at 20° C., using the plate as the anode.

As a result of this treatment, a uniform, lustrous, beautiful gold-colored aluminum plate is obtained.

EXAMPLE 2

After the aluminum plate has been degreased with trichloroethylene, the plate as the anode is treated for 30 minutes in a 10 wt.% solution of trisodium phosphate at 30° C., with a direct current having a current density of 1 A/dm$^2$.

The plate is then washed with water and immersed in a 10 wt.% solution of nickel sulfate.

Upon passage of an alternating current of 10 volts at 20° C., for 10 minutes, the plate and a carbon bar being employed as the electrodes, a pale brown, colored film is obtained on the surface of the plate.

Subsequently, the plate, as the anode is treated further in the same solution with a direct current of 50 volts at 20° C. for 2 minutes.

Upon immediate passage of the direct current the surface of the plate is colored a uniform lustrous beautiful gold.

EXAMPLE 3

A degreased aluminum plate is anodized in a 5 wt.% solution of sulfuric acid at 20° C. for 30 minutes with a direct current having a current density of 1.0 A/dm$^2$.

After the plate is washed, it is immersed in an aqueous solution of 50 parts by weight of ferrous sulfate and 950 parts by weight of water and an alternating current of 10 volts is passed at 20° C. for 10 minutes, using the plate and a carbon bar as electrodes.

This resulted in the formation of a pale yellow colored film on the plate.

Thereafter, the plate is washed with hot water at 40° C., and immersed in 15% aqueous solution of acrylic resin.

A direct current of 150 volts is passed at 20° C. for 2 minutes, using this plate as an anode and another aluminum plate as a cathode.

The solution of acrylic resin was prepared as follows: Into a reactor equipped with an agitator, a thermometer and a reflux condenser, 42.5 parts of butyl cellosolve and 44.5 parts of methanol were fed and heated at 70° C.

While maintaining a reflux temperature of 70° C., 5.5 parts of methacrylic acid, 25 parts of ethylacrylate, 44.5 parts of methylmethacrylate, five parts of styrene, 1.5 parts of benzoylperoxide and one part of dodecylmercaptan were mixed together and fed into the reactor together with 20 parts of methylolacrylamide, in five portions at intervals of one-half hour.

The reactants were then heated and agitated for four hours under reflux conditions.

After the conclusion of the reaction, the contents were cooled to 60° C.

The acid component was neutralized with a 28 percent solution of ammonium hydroxide and the reaction product was diluted with water until the solid matter content was 15 percent.

Since both the reactions of electrodeposition and of coloring progress simultaneously in this solution, not only the coating of transparent resin but also the coloring in gold took place on the anodized plate.

Subsequently, when the plate is washed with water and baked at 180° C. for 30 minutes, a uniform, lustrous, gold-colored aluminum plate is obtained.

EXAMPLE 4

A degreased aluminum plate is oxidized in a 1.5 wt.% solution of potassium hydroxide at 30° C. with a direct current having a current density of 2 A/dm$^2$.

After the plate is washed with water, the plate is immersed in an aqueous solution of 70 parts by weight of nickel nitrate and 930 parts by weight of water.

Thereafter an alternating current of 10 volts is passed at 20° C. for 10 minutes, using the plate and a carbon bar as electrodes.

This resulted in a pale yellow-colored plate being obtained.

Subsequently, the plate is treated with a direct current of 100 volts in the same solution at 20° C. for 2 minutes, using the plate as an anode.

A deep brown colored aluminum plate is obtained.

EXAMPLE 5

A degreased aluminum plate is oxidized for 30 minutes in a 10 wt.% solution of sulfuric acid at 20° C. with a direct current having a current density of 1 A/dm$^2$.

The plate is then washed with hot ater at 60° C. and immersed an aqueous solution of 8 wt.% of nickel nitrate and 2 wt.% of cobalt nitrate.

Upon passage of an alternating current of 15 volts for 4 minutes in this solution at 20° C., using the plate and a carbon bar as electrodes, a quite pale brown colored film on the plate is obtained.

The plate is washed and as an anode put into a 15% clear aqueous solution of acrylic melamine resin and treated with a direct current of 150 volts at 20° C. for 2 minutes while using another alumimum plate as a cathode.

The aqueous solution of resin was prepared by feeding into a reactor equipped with an agitator, a thermometer and a reflux condenser, 50 parts of cellosolve and 37 parts of methanol and heating the reactor content to initiate the reflux and maintain the reflux condition.

Thereafter there was added in five portions at intervals of one-half hour to the reactor a mixture of five parts of acrylic acid, five parts of hydroxyethylacrylate, 20 parts of ethylacrylate, 45 parts of methylmethacrylate, 5 parts of butylacrylate, 1.5 parts of benzoylperoxide and 0.5 parts of dodecylmercaptan.

After the conclusion of the feeding the mixture was heated and stirred for 5 hours under reflux. At the conclusion of the reaction the resin was cooled.

Acid components were rendered neutral with triethylamine after which the mixture was diluted with water until the solid matter content was 30 percent.

In this manner, a resin solution freely miscible with water was produced.

This solution and a water-soluble melamine resin were mixed at a ratio of solid matter content of 1:1 and were reacted together at 80° C. for 1 hour.

The product was diluted with water.

Subsequently, the plate is washed with hot water at 50° and baked at 130° C. for 20 minutes.

A plate having a uniform, lustrous, and beautiful brown coating is obtained.

EXAMPLE 6

A degreased aluminum plate is oxidized for 30 minutes in a 15 wt.% aqueous sulfuric acid solution with a direct current having a current density of 1 A/dm$^2$.

The plate is washed with water at 40° C., placed in an aqueous solution of 10 wt.% ferrous sulfate and of 3wt.% cobalt nitrate and then treated with an alternating current of 15 volts at 20° C. for 4 minutes, using the plate and a carbon bar as electrodes.

The oxidized film on the aluminum plate becomes a pale brown.

The plate is washed, placed as an anode in a 10% aqueous solution of alkyd modified acrylic resins and treated with a direct current of 180 volts at 20° C. for 3 minutes while using another aluminum plate as a cathode.

The aqueous solution of resin was prepared by feeding into a reactor equipped with an agitator, a thermometer and a reflux condenser attached with a blowing inlet for nitrogen gas and a separating tube, 330 parts of safflower oil, 100 parts of glycerol and 0.2 parts of sodium methylate.

While introducing nitrogen gas into the reactor, the ester-exchanging reaction was carried out at a temperature of between 230° and 240° C. for 2 hours.

After cooling 220 parts of phthalic anhydride and 50 parts of cyclohexanone were added and esterification undertaken at a temperature of between 180° and 210° C. to produce an alkyd resin with an acid value of 30.

then an alkyd resin having an acid value of 30 was produced by adding 220 parts of phthalic anhydride.

Into a reactor similar to that of Example 3 were fed 20 parts of the alkyd resin, 55 parts of ethyl cellosolve and 32 parts of methanol.

Further a mixture of five parts of methacrylic acid, five parts of hydroxyethyl methacrylate, 40 parts of ethyl acrylate, five parts of styrene, 1.5 parts of benzoyl peroxide and 20 parts of methylol acrylamide were divided into five portions and a portion added every 30 minutes to the contents of the reactor while maintaining the contents of the reactor at the boiling point.

Thereafter, it was refluxed and stirred for 4 hours.

After the completion of the reaction the contents of the reactor were cooled.

Thereafter the acid values of methacrylic acid and alkyd resin were rendered neutral with diethylamine after which the mixture was diluted with water until the content of solid matter was 10 percent.

The oxidized film of the aluminum plate is coated with transparent resin by means of electrodeposition and becomes a blackish gold-colored film.

Subsequently, the plate is washed and baked at 160° C. for 20 minutes to obtain an aluminum plate having a uniform, lustrous, beautiful surface.

EXAMPLE 7

A degreased aluminum is oxidized for 30 minutes in a 10 wt.% aqueous solution of sulfuric acid with direct current having a current density of 1 A/dm$^2$.

The plate is washed, placed as an anode in an aqueous solution of 3 wt.% of nickel acetate and treated with an alternating current of 15 volts at 20° C. for 4 minutes, using a carbon bar as a cathode.

Subsequently, the plate is placed as an anode in a aqueous solution of 10% concentration of acrylic resin and treated for 1.5 minutes with a direct current of 150 volts, using another aluminum plate as a cathode.

The acrylic resin employed was the same as that of Example 3.

The plate is washed and baked at 150° C. for 20 minutes to produce a brown colored aluminum plate coated with a lustrous, transparent resin.

EXAMPLE 8

The aluminum plate is oxidized as described in Example 7, and washed with hot water at 60° C.

The plate is put into an aqueous solution of 10 wt.% of ferrous citrate and 3 wt.% of cobalt acetate and treated for 4 minutes with alternating current of 1.5 volts at 20° C., using the plate and a carbon bar as electrodes.

The plate is washed with water at room temperature and put into a 15% aqueous solution of alkyd modified acrylic melamine resin.

The solution of alkyd modified acrylic melamine resin was prepared by feeding into a reactor similar to that of Example 3, 192 parts of trimethylolpropane, 132 parts of sebacic acid, 67 parts of safflower aliphatic acid and eight parts of cyclohexanone and heating the reactor content to 200° C. to produce, by esterification, an alkyd resin with an acid value of 50.

To a similar second reactor were fed 20 parts of the alkyd resin obtained in the first reactor, 35 parts of cyclohexanone, 13 parts of isopropyl alcohol and 10 parts of methanol.

While maintaining the contents of the second reactor at the boil, a mixture of three parts of methacrylic acid, 40 parts of methyl methacrylate, 42 parts of ethyl acrylate and 1.5 parts of benzoyl peroxide was added thereto in five portions at intervals of one-half hour.

After the conclusion of the addition, polymerization was continued for 6 hours under reflux conditions.

Then, the contents were cooled and triethylamine was added to render the acid value of the alkyd resin and methacrylic acid neutral.

By diluting the contents with water until the solids content was 30 percent, a resin solution freely soluble in water was produced.

This resin solution and water-soluble melamine resin were mixed in the ratio of solid matter content of 1:1 and then diluted with water until the content of solid matter was 15 percent.

The electrodeposition and the baking are carried out by the same method as described in Example 7.

An amber gold colored aluminum plate is obtained.

EXAMPLE 9

A degreased 99.8% pure aluminum plate is oxidized for 30 minutes in 15% aqueous sulfuric acid with a direct current having a current density of 1 A/dm$^2$.

The plate is placed as an anode in an aqueous solution of 15 wt.% of nickel sulfate and 2 wt.% of cobalt sulfate and then treated for 10 minutes with an alternating current of 10 volts, using the plate and a carbon bar as electrodes.

Subsequently, the plate is immersed in a 0.001% aqueous solution of ammonium sulfate having an electrical conductivity of 200 $\mu\Omega^{-1}cm^{-1}$ after which a direct current of 50 volts is passed in this solution for 3 minutes, using the plate as an anode and stainless steel as a cathode.

As a result of this treatment, a deep brown colored film is obtained.

EXAMPLE 10

A 6063 aluminum alloy is oxidized and treated with an alternating current in a 1% aqueous solution of nickel sulfate under the same conditions as described in Example 9.

Thereafter the aluminum alloy plate is treated for 5 minutes with direct current of 20 volts in a 0.1% aqueous solution of sodium carbonate having an electrical conductivity of 2000 $\mu\Omega^{-1}cm^{-1}$.

As a result of this treatment, the oxidized film of the aluminum alloy becomes a deep brown color.

EXAMPLE 11

As described in Example 9, the 99.8% aluminum plate is oxidized.

After the anodic oxidation, the plate is treated for 5 minutes with an alternating current of 13 volts in a 10% aqueous solution of nickel acetate.

Subsequently, the plate is treated for 5 minutes with a direct current of 150 volts in a 0.01% aqueous solution of potassium nitrate, using the plate as an anode.

A reddish brown aluminum plate is obtained.

Thereafter the colored plate is immersed in a 23% aqueous solution of water-soluble acrylic resin and then baked at 180° C. for 30 minutes.

The 23% solution of water-soluble acrylic resin was prepared in accordance with th procedure of Example 5.

The colored aluminum plate obtained is reddish brown, and fade-resistant.

The color film persisted under sunshine for 2000 hours.

What we claim is:

1. In a method of coloring articles of aluminum and aluminum alloys which comprises passing for from 2 to 30 minutes an alternating current at up to 30 volts from the article of aluminum or aluminum alloys having an oxidized film thereon through an aqueous solution containing Group 8 metal salts at a temperature of from 5°–40° C. and then passing direct current at from 10–200 volts for from 0.5 to 10 minutes with the aluminum material article acting as an anode through an aqueous solution of electrolyte the improvement which comprises rendering said aqueous solution containing metal salts devoid of added acids and/or salts of metals thereof where they are other than Group 8 metals to form a uniformly colored article.

2. The method of claim 1 in which the aqueous solution of electrolyte through which the direct current is passed is an aqueous solution of more than 10 $\mu\Omega^{-1}cm^{-1}$ conductivity.

3. The method of claim 2 in which the pH of the solution of electrolyte is from 2 to 11.

4. The method of claim 2 in which the article colored by the previous treatment is coated with resin after the passage of direct current.

5. The method of claim 1 in which the aqueous solution of electrolyte through which the direct current is passed is the same solution as that through which the alternating current is passed.

6. The method of claim 5 in which the article colored by the previous treatment is coated with resin after the passage of direct current.

7. The method of claim 1 in which the aqueous solution of electrolyte through which the direct current is passed is a dispersion, emulsion or aqueous solution containing water-soluble resins.

8. The method of claim 7 in which the direct current is passed through an aqueous solution of electrolyte containing a water-soluble, emulsion or dispersion of resin which is selected from acrylic, alkyd, acrylic-alkyd, epoxy and phenolic resins, reaction products of such resins with organic amines or ammonium hydroxide, a mixture of said resins and a mixture of said resins with melamine resins.

9. The method of claim 1 in which the temperature of the solution through which the alternating current is passed is from 10° to 35° C.

10. The method of claim 1 in which the voltage of the alternating current is from 5 to 25 volts.

11. The method of claim 1 in which the total concentration of salt (s) of metal (s) in the solution through which the alternating current is passed is from 0.5 to 15 wt.%.

12. In a method of coloring articles of aluminum and aluminum alloys which comprises passing for from 2 to 30 minutes an alternating current at up to 30 volts from the article of aluminum or aluminum alloys having an oxidized film thereon through an aqueous solution containing group 8 metals salts at a temperature of from 5°–40° C. and then passing direct current at from 50–300 volts for from 0.5 to 5 minutes with the aluminum material article acting as an anode through an aqueous solution of electrolyte containing a water-soluble resin having a temperature of from 10° to 30° C. and a pH of from 7.5 to 10.5, said electrolyte having a concentration of resin of from 3 to 4 wt.%, the improvement which comprises rendering said aqueous solution containing metal salts devoid of added acids and/or salts of metals thereof where they are other than Group 8 metals to form a uniformly colored article.

* * * * *